US005147750A

United States Patent [19]

Nakanishi

[11] Patent Number: 5,147,750

[45] Date of Patent: Sep. 15, 1992

[54] ELECTROPHOTOGRAPHIC TONER AND CHARGE CONTROLLER THEREFOR

[75] Inventor: Hideo Nakanishi, Ohtsu, Japan

[73] Assignee: Sanyo Chemical Industries, Ltd., Kyoto, Japan

[21] Appl. No.: 538,094

[22] Filed: Jun. 13, 1990

[30] Foreign Application Priority Data

Jun. 13, 1989 [JP] Japan ..... 1-151361

[51] Int. Cl.[5] ..... G03G 9/087

[52] U.S. Cl. ..... 430/110; 430/96

[58] Field of Search ..... 430/110, 96

[56] References Cited

U.S. PATENT DOCUMENTS 4,021,358 3/1977 Tomono et al. ..... 252/62.1
4,812,377 3/1989 Wilson et al. ..... 430/110
4,840,863 6/1989 Otsu et al. ..... 430/110
4,845,005 7/1989 Niki et al. ..... 430/110

FOREIGN PATENT DOCUMENTS 0254543 7/1987 European Pat. Off. .
0298279 6/1988 European Pat. Off. .
1312776 4/1973 United Kingdom .

*Primary Examiner*—John Goodrow
*Attorney, Agent, or Firm*—Oblon, Spivak, McClelland, Maier & Neustadt

[57] ABSTRACT

Polymers, comprising block-wise or/and graft-wise linked (A) a polymer having amino group-containing monomer units and (B) at least one polymer such as styrenic polymers, olefinic polymers, polyesters, epoxy resins and polyurethanes, are useful as charge controllers for electrophotographic toners.

21 Claims, No Drawings

ELECTROPHOTOGRAPHIC TONER AND CHARGE CONTROLLER THEREFOR

BACKGROUND OF THE INVENTION

1. Field of the Invention

This invention relates to charge controllers for toner and toners containing them.

2. Description of the Prior Art

It has been known to use charge controllers, charging negatively or positively, for the purpose of providing charge toners, used for developing electrostatic latent images in electrophotography (xerography), electrostatic recording papers, and so on.

As positively charging charge controllers of polymer type, there have been known polyamine resins (such as JPN Patent Publication No. 13284/1978), and acrylic resins containing quaternary ammonium salts (such as JPN Patent Lay-open No. 210472/1987).

In these known charge controllers, there are problems, that distribution of electrostatic charging amount become broader because of insufficient distersibility into toner binder, and that reduction of functionality in order to improving dispersibility results in insufficient electrostatic charging or unstable electrostatic charging.

SUMMARY OF THE INVENTION

It is an object of the present invention to provide a charge controller providing narrow electrostatic charge distribution when used in toner.

It is another object of the present invention to provide a charge controller capable of stably keeping proper electrostatic charging amount.

It is still another object of the present invention to provide a toner showing narrow electrostatic charge distribution.

It is yet another object of the present invention to provide a method of fixing a toner image with proper and stable electrostatic charging amount.

Briefly, these and other objects of this invention as hereinafter will become more readily apparent have been attained broadly by a charge controling polymer, said polymer comprising moiety of (A) a polymer having amino group-containing monomer units and moiety of (B) at least one polymer selected from the group consisting of styrenic polymers, olefinic polymers, polyesters, epoxy resins and polyurethanes; the moiety of (A) and the moiety of (B) being linked block-wise or/and graft-wise; by an electrophotographic toner or toner binder comprising said charge controling polymer.

DETAILED DESCRIPTION OF THE PREFERRED EMBODIMENTS

In this invention, said amino group in the moiety of said polymer (A) is selected from the group consisting of primary, secondary and tertiary amino groups, salts thereof, quaternary ammonium salt groups.

Suitable amino groups include: 1) primary amino groups, for example, aminoalkyl groups (such as aminoethyl, aminobutyl and aminohexyl), and aminoaryl groups (such as aminophenyl); 2) secondary amino groups, for example, those in the forms of (or the residues of) alkyl amines (such as methylethylamine and dibutylamine), of aralkyl amines (such as benzylmethylamine) and of aryl amines (such as methyaniline); 3) tertiary amino groups, for example, those in the forms of alkyl amines (such as dimethylethylamine, dimethylpropylamine and methyldibutylamine), of aralkyl amines (such as benzyldiethylamine), of aryl amines (such as dimethyaniline), of saturated heterocyclic amines (such as ethylpiperidine, ethylmorpholine and diethylpiperazine), of unsaturated heterocyclic amines (such as pyridine, quinoline, thiazole, benzothiazole, pyrazine, quinoxaline, 1-benzylimidazole and 1-benzylbenzoimidazole); 4) salts of amino groups, for example, the above amino groups neutralized with organic acids (such as p-toluenesulfonic acid and hydroxynaphthosulfonic acid) and with inorganic acids (such as hydrochloric acid, tetrafluoro-boric acid and molybdic acid); 5) amine salts of organic acid groups, such as salts of sulfonic acid group with amines (such as trimethylamine, tributylamine, dimethylaniline, pyridine, thiazole and quinoxaline); and 6) quaternary ammonium salt groups, for example, alkyl ammonium salt groups (such as trimethylethylammonium, dimethyldiethylammonium, trimethylbutylammonium and dimethyldibutylammonium salt groups), aralkyl ammonium salt groups (such as benzyldiethylmethylammonium and dibenzyldiethylammonium salt groups), aryl ammonium salt groups (such as phenyltrimethyammonium salt group), saturated heterocyclic ammonium salt groups (such as piperidinium, morpholinium and piperazinium salt groups), unsaturated heterocyclic ammonium salt groups (such as pyridinium, quinolinium, oxazolium, thiazolium, benzothiazolium, pyrazinium, quinoxalinium, imidazolium and benzoimidazolium salt groups), and betain groups, such as carboxybetain and sulfobetain groups of the above tertiary amino groups betainated with known betainating or sulfobetainating agents (as described below).

Among these, preferred are tertiary amino groups, quaternary ammonium salts and betain groups, particularly quaternary ammonium salts and betain groups.

Suitable examples of said polymer (A) include those containing one or more amino-containing groups, in the side chain or/and in the polymer backbone, which groups are selected from the group consisting of those represented by any of the formulae (1), (2), (3), (4), (5) and (6):

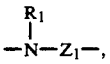
(1)

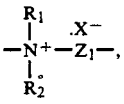
(2)

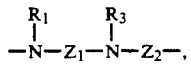
(3)

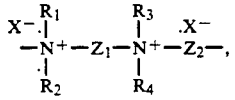
(4)

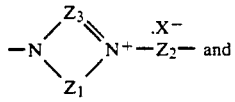
(5) and

-continued

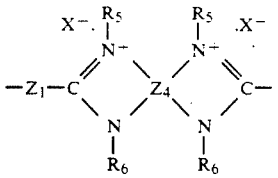

(6)

wherein $R_1$, $R_2$, $R_3$, $R_4$, $R_5$ and $R_6$ are independently selected from the group consisting of hydrogen atom and monovalent substituted or unsubstituted hydrocarbon groups, containing up to 18 carbon atoms; or $R_1$ and $R_2$, $R_1$ and $R_3$, $R_2$ and $R_4$, $R_3$ and $R_4$ or two or more of these combinations may be joined each other to form a heterocyclic ring; or $R_1$ and $R_2$ or $R_3$ and $R_4$ may be joined with a part of $Z_1$ to form a heterocyclic ring; $Z_1$, $Z_2$ and $Z_3$ are independently selected from the group consisting of substituted and unsubstituted hydrocarbon groups, containing up to 18 carbon atoms, which may contain at least one linkage selected from the group consisting of ether, thioether, ester, amide and imide linkages; $Z_4$ is a tetravalent aromatic group, which may contain at least one linkage selected from the group consisting of ether and thioether linkages; and $X^-$ is an anionic counter ion.

In the above, examples of said monovalent substituted or unsubstituted hydrocarbon groups include alkyl groups (such as methyl, ethyl, propyl, butyl, octyl and decyl), aralkyl groups (such as benzyl), aryl groups (such as phenyl), cycloalkyl groups (such as cyclohexyl), and hydroxyalkyl groups (such as 4-hydroxybutyl). Examples of suitable heterocyclic rings, formed from $R_1$ and $R_2$, $R_1$ and $R_3$, $R_2$ and $R_4$, $R_3$ and $R_4$, or $R_1$ and $R_2$ or $R_3$ and $R_4$ with a part of $Z_1$, are saturated heterocyclic rings, formed from $R_1$ and $R_2$ and/or $R_2$ and $R_4$, such as morpholine ring, piperidine ring, pipecoline ring and lupetidine ring; saturated heterocyclic rings, formed from $R_1$ and $R_3$ and/or $R_3$ and $R_4$, such as piperazine ring; unsaturated heterocyclic rings formed from $R_1$ and $R_2$ with a part of $Z_1$, or $R_3$ and $R_4$ with a part of $Z_1$, such as pyridine ring, quinoline ring and acridine ring. Among these preferred are alkyl groups, aralkyl groups, and unsaturated heterocyclic rings (a part of $Z_1$ having been joined).

Suitable divalent substituted and unsubstituted hydrocarbon groups of $Z_1$ include divalent substituted and unsubstituted $C_1$–$C_{18}$ hydrocarbon groups, for example, alkylene groups, such as methylene, ethylene, tetramethylene and hexamethylene; alkenylene groups, such as vinylene; aralkylene groups, such as phenylenemethylene and phenylenedimethylene; arylene, such as phenylene; and hydroxyalkylene groups, such as 2-hydroxytrimethylene. Among these, oreferred are alkylene and aralkylene groups.

Examples of $Z_2$ include the same ones as above $Z_1$, and $C_1$–$C_{18}$ hydrocarbon groups containing ether, thioether, ester, amide or/and imide linkages, such as $$-CH_2CH_2OCH_2CH_2-,\ -CH_2CH_2OCH_2CH_2OCH_2CH_2-;$$

$$-CH_2CH_2SCH_2CH_2-;$$

$$-CH_2CH_2COOCH_2CH_2OCOCH_2CH_2-,$$

$$-\underset{\underset{CH_3}{|}}{CH_2CH}-COO-CH_2\overset{\overset{CH_3}{|}}{\underset{\underset{CH_3}{|}}{C}}CH_2OCO\underset{\underset{CH_3}{|}}{CH}-CH_2-;$$

-continued $$-CH_2CH_2CONHCH_2CH_2NHCOCH_2CH_2-,$$

$$-CH_2CH_2CON\left\langle\begin{matrix}CH_2CH_2\\CH_2CH_2\end{matrix}\right\rangle NCOCH_2CH_2-;\ \text{and}$$

$$\begin{matrix}-CH-CO\\|\\CH_2CO\end{matrix}\ \rangle NCH_2CH_2CH_2CH_2CH_2CH_2N\langle\ \begin{matrix}CO-CH-\\|\\CO-CH_2\end{matrix}$$

Among these, preferred are alkylene groups, aralkylene groups, ether-containing hydrocarbon groups and amide-containing hydrocarbon groups.

Illustrative of suitable substituted and unsubstituted hydrocarbon groups of $Z_3$ are trivalent substituted and unsubstituted $C_1$–$C_{18}$ hydrocarbon groups, such as those of the formula =CR—, wherein R is H, methyl, ethyl, benzyl, phenyl, 2-hydroxyethyl or 2-methoxyethyl. Among R's, preferred are H, methyl and phenyl.

Exemplary of tetravalent aromatic group $Z_4$ are:

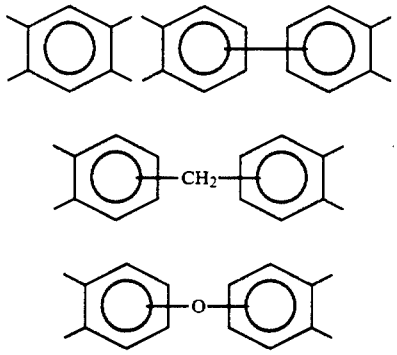

Among these preferred are the latter two.

Illustrative examples of anionic counter ion $X^-$ include halogen ions (such as $Cl^-$, $Br^-$ and $I^-$), sulfate ions, nitrate ion, phosphate ions, sulfonate ions (such as p-toluenesulfonate ion, methylsulfonate ion and hydroxynaphthsulfonate ion), borate ions (such as tetrafluoroborate ion and tetraphenylborate ion), oxoacid ions (such as molybdate ion and tungstate ion), and the like. Among these, preferred are halogen ions, sulfonate ions and oxoacid ions.

Polymers (A), containing amino-containing groups in the side chain, include those comprising monomer units having at least one amino-containing group in the side chain, for example, those having nitrogen atoms of said amino groups covalently bound directly to the monomer unit side chains; those having organic acid groups covalently bound directly to monomer unit side chains, said acid groups being in the forms of amine salts or quaternary ammonium salts. Among these, preferred are the formers.

Examples of suitable monomer units having said amino group in the side chain are vinyl monomer units, polyester monomer units and polyether monomer units. [In the above and hereinafter, "polyester monomer" and "polyether monomer" represent "polyester-forming monomer" and "polyether-forming monomer", respectively.] Among these, preferred are vinyl monomer units and polyether monomer units, particularly the formers.

Suitable monomers constituting amino-containing vinyl monomer units include, for example, vinyl monomers [(methyl)acrylamides, (meth)acrylates, maleimides, styrenic monomers (styrene derivatives), olefins, dienes, vinyl ethers and the like], containing a tertiary amino group or/and quaternary ammonium group. [In the above and hereinafter, "(meth)acrylamides" represents acrylamide and methacrylamide; and similar expressions are used.]

Illustrative examples of tertiary amino group-containing vinyl monomers are:

1) tertiary alkylamino-containing vinyl monomers, for example, tertiary alkylamino-containing (meth)acrylamides, such as N,N-dimethylaminopropyl(meth)acrylamides; tertiary alkylamino-containing (meth)acrylates, such as N,N-dimethylaminoethyl(meth)acrylates; tertiary alkylamino-containing maleimides, such as N,N-diethylaminoethyl maleimides; tertiary alkylamino-containing styrenic monomers, such as p-dimethylaminostyrene and p-dimethylaminomethylstyrene; dialkylvinylamines, such as dibutylvinylamine; tertiary alkylamino-containing dienes, such as 2-diethylaminobutadiene; tertiary alkylamino-containing vinyl ethers, such as N,N-diethylaminoethyl vinyl ether; and the like;

2) tertiary aralkylamino-containing vinyl monomers, for example, tertiary aralkylamino-containing (meth)acrylates, such as N,N-dibenzylaminoethyl(meth)acrylates; tertiary aralkylamino-containing styrenic monomers, such as p-dibenzylaminomethylstyrene; aralkylvinylamines, such as dibenzylvinylamine; tertiary aralkylamino-containing dienes, such as 2-dibenzylaminobutadiene; tertiary aralkylamino-containing vinyl ethers, such as N-benzyl-N-ethyl-aminoethyl vinyl ether; and the like;

3) tertiary arylamino-containing vinyl monomers, for example, tertiary arylamino-containing (meth)acrylates, such as N,N-diphenylaminoethyl(meth)acrylates; tertiary arylamino-containing styrenic monomers, such as p-diphenylaminomethylstyrene; arylvinylamines, such as diphenylvinylamine; tertiary arylamino-containing vinyl ethers, such as N-phenyl-N-ethylaminoethyl vinyl ether; and the like;

4) tertiary saturated heterocyclic amino-containing vinyl monomers, for example, tertiary saturated heterocyclic amino-containing (meth)acrylamides, such as piperidinopropyl(meth)acrylamides and pipecolinopropyl(meth)acrylamides; tertiary saturated heterocyclic amino-containing (meth)acrylates, such as morpholinoethyl(meth)acrylates; tertiary saturated heterocyclic amino-containing maleimides, such as piperidinoethylmaleimide; tertiary saturated heterocyclic amino-containing styrenic monomers, such as p-morpholinostyrene and p-piperidinomethylstyrene; N-vinyl unsaturated heterocyclic amines, such as N-vinylpipecoline and N-vinylpyrolidine; tertiary saturated heterocyclic amino-containing dienes, such as 2-lupetidinobutadiene; tertiary saturated heterocyclic amino-containing vinyl ethers, such as morpholinoethyl vinyl ether; and the like; and 5) tertiary unsaturated heterocyclic amino-containing vinyl monomers, for example, tertiary unsaturated heterocyclic amino-containing (meth)acrylamides, such as pyridinoethyl(meth)acrylamides; tertiary unsaturated heterocyclic amino-containing (meth)acrylates, such as pyridinomethyl(meth)acrylates; tertiary unsaturated heterocyclic amino-containing styrenic monomers, such as vinyl-benzylimidazole and vinylbenzylbenzoimidazole; vinyl unsaturated heterocyclic amines, such as vinylcarbazoles, vinylpyridines, vinylimidazoles, benzoimidazoles; and the like.

Examples of suitable quaternartiary ammonium group-containing vinyl monomers are 1) quaternary alkylammonium salt-containing vinyl monomers, quaternary aralkylammonium salt-containing vinyl monomers, quaternary aryl-ammonium salt-containing vinyl monomers, quaternary saturated heterocyclic ammonium salt-containing vinyl monomers and quaternary unsaturated heterocyclic ammonium salt-containing vinyl monomers, obtainable by quaternarization of the above-mentioned tertiary amino group-containing vinyl monomers with an alkylating agent; and 2) unsaturated heterocyclic ammonium salt-containing vinyl monomers, for example, unsaturated heterocyclic ammonium salt-containing styrenic monomers, such as vinylbenzylpyridinium chloride, vinylbenzylquinolinium chloride, vinylbenzylacridinium chloride, vinylbenzylthiazolium chloride and vinylbenzyloxazolium chloride; vinyl-containing unsaturated heterocyclic ammonium salts, such as vinylpyridinium chloride, vinylacridinium chloride, vinylbenzothiazolium chloride and vinylbenzoxazolium chloride; and unsaturated heterocyclic ammonium salt-containing vinyl ethers, such as vinyloxyethylpyridinium chloride; and the like; as well as 3) betain group-containing vinyl monomers, obtainable by betainating the above-mentioned tertiary amino group-containing vinyl monomers with a betainating agent. Suitable alkylating agents include, for example, halogenated hydrocarbons, such as methyl chloride, methyl iodide, ethyl bromide, butyl bromide, butyl chloride, benzyl chloride and benzyl bromide; sulfate esters, such as dimethyl sulfate and diethyl sulfate; trialkyl phosphates, such as trimethyl phosphate; and so on. Illustrative of suitable betainating agents are carboxybetainating agents, such as chloroacetic acid, bromoacetic acid, and alkali salts of them; and sulfobetainating agents, such as 1,3-propanesultone, chloroethane sulfonic acid and alkali salts thereof.

Among these amino group-containing vinyl monomers, preferred are tertiary amino-containing vinyl monomers and particularly quaternary ammonium-containing vinyl monomers.

Suitable monomers constituting polyether monomer units containig amino group in the side chain include polymerizable cyclic ethers, containing a tertiary amino group or/and quaternary ammonium group and capable of forming polyether through ring-opening polymerization.

Illustrative examples of tertiary amino group-containing polyether monomers are: tertiary alkylamino-containing polyether monomers (such as dimethylaminomethylEO and dibutylaminomethylEO), tertiary aralkylamino-containing polyether monomers (such as dibenzylaminomethylEO), tertiary arylamino-containing polyether monomers (such as diphenylaminomethyEO), tertiary saturated heterocyclic amino-containing polyether monomers (such as morpholinomethylEO and piperidinomethylEO), tertiary unsaturated heterocyclic amino-containing polyether monomers (such as 1-glycidylimidazole and 1-glycidylbenzoimidazole). [In the above and hereinafter, EO represents ethylene oxide.]

Examples of suitable quaternartiary ammonium group-containing polyether monomers are quaternary alkylammonium salt-containing polyether monomers (such as glycidyltributyl ammonium chloride), quaternary aralkylammonium salt-containing polyether monomers (such as glycidylbenzyltrimethyl ammonium chloride), quaternary saturated heterocyclic ammonium salt-containing polyether monomers (such as glycidylmethylpiperidinium chloride), quaternary unsaturated heterocyclic ammonium salt-containing polyether monomers (such as 1-glycidyl-3-benzylbenzoimidazolium chloride); and betain group-containing polyether monomers, obtainable by betainating the above-mentioned tertiary amino group-containing polyether monomers with a betainating agent (such as chloroacetic acid and 1,3-propane sultone).

Among these amino group-containing polyether monomers, preferred are tertiary amino-containing polyether monomers and particularly quaternary ammonium-containing polyether monomers.

Suitable monomers constituting polyester monomer units containig amino group in the side chain include ester-forming compouds (such as lactones, hydroxycarboxylic acids, or combination of diols with dicarboxylic acids) containing a tertiary amino group or/and quaternary ammonium group.

Polymers (A), containing amino-containing groups in the polymer backbone, include polymers having a backbone comprising one or more monomer units represented by the formulae (1), (2), (3), (4), (5) and/or (6).

Illustrative of suitable monomer units of the formula (1), (2), (3), (4), (5) or (6) are:

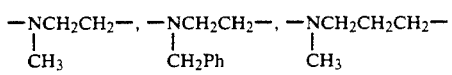

(1)

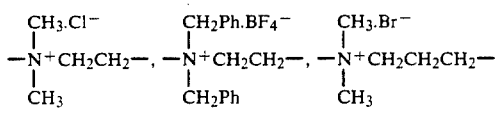

(2)

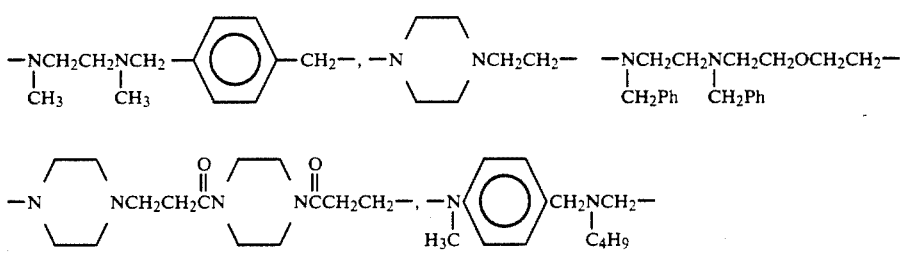

(3)

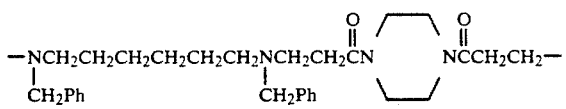

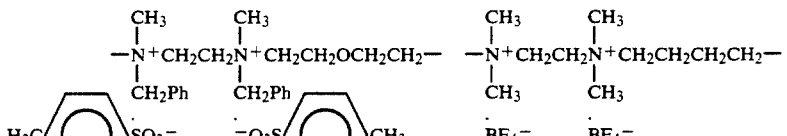

(4)

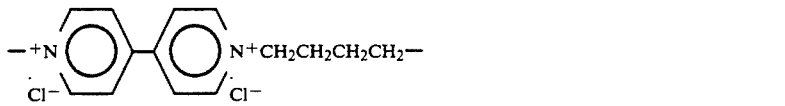

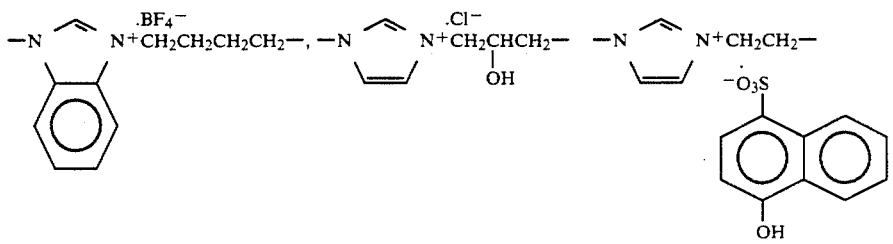

(5)

-continued

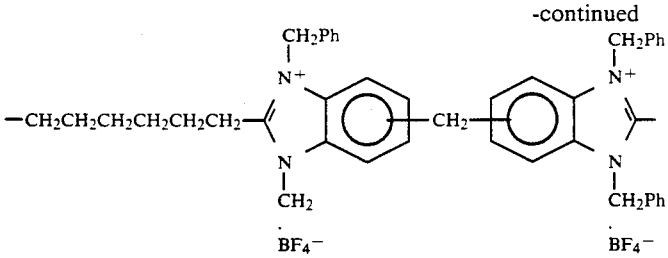

(6)

Among these, preferred are those of the formulae (2), (4), (5) and (6). Particularly preferred are those of the formula (5), wherein $Z_1$ is alkenylene or arylene group and $Z_3$ is a divalent substituted and unsubstituted hydrocarbon group of the formula =CR— (wherein R is H, methyl, ethyl, benzyl, phenyl, 2-hydroxyethyl or 2-methoxyethyl).

Said polymers (A), containing one or more amino-containing groups in the side chain or/and in the polymer backbone, include polymers comprising monomer units having said amino-containing groups in the side chain or/and in the polymer backbone, and copolymers comprising such monomer units having said amino-containing groups and one or more other monomer units.

Monomers constituting said other monomer units are not particularly restricted, as far as copolymerizable with said amino-containing monomers.

Examples of suitable other monomers copolymerizable with amino-containing vinyl monomers are styrenic monomers, for example, styrene and styrene homologues or substituted styrenes, including alkyl($C_1$–$C_{18}$)styrenes (such as alpha-methylstyrene, o-, m- and p-methylstyrenes, p-ethylstyrene, 2,4-dimethylstyrene, p-n-butylstyrene, p-t-butylstyrene, p-n-hexylstyrene, p-n-octylstyrene, p-n-nonylstyrene and p-n-decylstyrene), aryl-substituted styrenes (such as p-phenylstyrene, p-cumylstyrene), alkoxy- or acyloxy-substituted styrenes (such as p-methoxystyrene and acetoxystyrene), hydroxystyrene and halogen-substituted styrenes (such as p-chlorostyrene, 3,4-dichlorostyrene); (meth)acrylic monomers, for example, alkyl($C_1$–$C_{18}$) (meth)acrylates [such as methyl, ethyl, n- and i-butyl, propyl, n-octyl, 2-ethylhexyl, dodecyl, lauryl and stearyl (meth)acrylates], aryl (meth)acrylates [such as phenyl (meth)acrylates], hydroxyl-containing (meth)acrylates [such as hydroxyethyl (meth)acrylates], epoxy-containing (meth)acrylates [such as glycidyl (meth)acrylates], and nitrile-containing monomers [such as (meth)acrylonitriles]; and other vinyl monomers, for instance, vinyl esters (such as vinyl acetate and vinyl propionate), aliphatic hydrocarbon monomers (such as butadiene and isoprene), vinyl ethers (such as methyl vinyl ether, ethyl vinyl ether, butyl vinyl ether and iso-butyl vinyl ether), vinyl ketones (such as vinyl methyl ketone, vinyl hexyl ketone and methyl isopropenyl ketone), halogen-containing vinyl monomers (such as vinyl chloride and vinyl bromide), and the like; as well as mixtures of two or more of them. Among these, preferred are styrenic monomers, (meth)acrylic monomers, vinyl esters and aliphatic hydrocarbon monomers, particularly styrene and alkyl (meth)acrylates.

Suitable other monomers copolymerizable with polyether monomers include polymerizable cyclic ethers, for example, three-membered cyclic ethers, including $C_2$–$C_8$ alkylene oxides and substituted alkylene oxides (such as EO, propylene oxide (hereinafter referred to as PO) and epichlorhydrin; and four-membered cyclic ethers, such as cyclooxabutane and 3,3-bis(chloromethyl)cyclooxabutane.

Molar ratio of said amino-containing monomer to said other monomer is usually 30:70–100:0, preferably 50:50–100:0.

Said polymers (A) may be produced by polymerization of amino-containing monomer (a) [and optionally other monomer (b)], or by polymerising precursor monomer (a') for (a) [and optionally (b)] and then converting the polymerized units of (a') into units of (a).

Polymers containing amino groups in the side chain can be produced, for example, 1) by (co)polymerizing a monomer, containing amino group in the side chain, and optionally another monomer; 2) by (co)polymerising a halogen-containing monomer and optionally another monomer, followed by reacting the resulting halogen-containing (co)polymer with an amine to alkylate them; 3) by (co)polymerizing a monomer having a reactive group (such as calboxyl group and hydroxyl group) and optionally another monomer, followed by the resulting (co)polymer with an amine having a group (such as hydroxyl group and amino group) reactive with the (co)polymer.

Polymers containing amino groups in the polymer backbone can be produced, for example, 1) by ring-opening polymerization of cyclic amines (three-membered to six-membered ones, such as aziridine); 2) by reducing or hydrolyzing an isomerized ring-opening polymerizate of 1,3-oxaza compound (such as oxazoline and oxazine); 3) by alkylating a dihalide (such as 1,4-dibromobutane and ethylene dichloride) with an amine (such as tetramethyl ethylenediamine and imidazole); 4) by reacting an amine (such as dibutylamine and imidazole) with epichlorhydrin; 5) by addition-polymerization of an amines (such as Michael addition-polymerization of diamine to bisacrylamide); 6) by addition-polycondensation of an amines [for instance, addition-polycondensation of an active hydrogen atom-containing amine (such as N-methylaniline) with an aldehyde (such as formalin); and 7) by ring-closing polycondensation of amines [for instance, ring-closing polycondensation of an aromatic tetramine (such as 3,3',4,4'-tetraaminodiphenylmethane) with a dicarboxylic acid (such as adipic acid) to form polybenzoimidazole].

These polymers containing amino groups may be used as such, or they can be further alkylated and/or betainated with alkylating agent and/or betainating agent (such as those mentioned above). Counter ions of quaternary ammonium salt groups after alkylation may be converted salts of other counter ions (such as p-toluene sulfonate, tetrafluoroborate and molybdate ions) by treating acids or alkali salts thereof.

Among said polymer (B) to be linked with said polymer (A) having amino groups, styrenic polymers include (co)polymers of styrenic monomers and copolymers of styrenic monomers with other comonomers.

Styrenic monomers include styrene and styrene homologues or substituted styrenes, such as those mentioned above. Examples of suitable comonomers are (meth)acrylic monomers and other vinyl monomers, as mentioned above; as well as unsaturated mono- or polycarboxylic acids [such as (meth)acrylic, ethacrylic, crotonic, sorbic, maleic, itaconic and sinnamic acids] and anhydrides or partial esters thereof (such as maleic anhydride and monomethyl maleate). Among styrenic polymers, preferred are polymers of styrene, copolymers of styrene with other monomers [preferably (meth)acrylic monomers and/or aliphatic hydrocarbon monomers, with or without a minor amount of other monomers]. Molar ratio of styrenic monomer (styrene) to other monomer is usually 100:0–30:70, preferably 100:0–50:50.

Olefinic polymers of (B) include, for example, (a) polymers of $C_2$–$C_8$ olefin, such as polyethylene, polypropylene, copolymers of ethylene with $C_2$–$C_8$ olefin(s) (such as those having ethylene content of at least 50% by weight, preferably at least 70%); (b) adducts of (a) with a maleic acid derivative (such as maleic anhydride, dimethyl maleate and di-2-ethylhexyl maleate); (c) oxidates of (a); and (d) copolymers of an ethylenically unsaturated hydrocarbon ($C_2$–$C_8$ olefin, such as ethylene, propylene and butene-1) with ethylenically unsaturated carboxylic acid [such as (meth)acrylic and itaconic acids] and/or esters thereof [such as alkyl($C_1$–$C_{18}$) esters]. Among these, preferred are polyethylene, polypropylene and maleic acid derivative adducts of them.

Suitable polyesters of (B) include, for example, polycondensation products of a dicarboxylic acid component with a diol component, and ring-opening polymers of a lactone. Illustrative of suitable dicarboxylic acid components are aromatic dicarboxylic acids, such as terephthalic, isophthalic, phthalic, naphthalenedicarboxylic and trimellitic acids; esters and halides of these acids, such as dimethyl terephthalate and terephthalic dichloride; $C_2$–$C_{30}$ aliphatic adipic, sebacic and dodecanedicarboxylic acids; and esters and halides of these acids, such as dimethyl adipate and adipic dichloride. Among these, preferred are aromatic dicarboxylic acid and combination thereof with aliphatic dicarboxylic acid. Examples of suitable diols include aliphatic diols, such as 1,3-propanediol, 1,4-butanediol, 1,6-hexanediol and neopentylglycol, and alcoholates (such as sodium alcoholate) of these diols; aromatic diols, such as bisphenols (such as bisphenol A, bisphenol S and bisphenol F) and hydroquinone, and esters and alcholates of these phenols (such as diacetylbisphenol A and bisphenol A disodium alcoholate); alkylene oxide ($C_2$–$C_4$) adducts of these aromatic diols, such as EO and/or PO adducts of bisphenol A and EO and/or PO adducts of bisphenol F; polyalkyleneglycols, such as polyethyleneglycol, polypropyleneglycol and polytetramethyleneetherglycol. Among these, preferred are alkylene oxide adducts of aromatic diols, aliphatic diols and combinations of them, particularly alkylene oxide adducts of aromatic diols. Suitable lactones include caprolactone. Polyesters may be hydroxyl-terminated or carboxyl-terminated.

Suitable epoxy resins of (B) include conventionally employed ones, as described in "EPOXY RESINS" published 1957 by McGraw-Hill, for example, glycidyl ethers, including those of phenol or bisphenol ether type [adducts of epichlorhydrin with phenolic compounds, including aromatic diols, such as bisphenols (such as bisphenol A), phenol novolak, cresol novolak, resorcinol and the like], phenol epoxy resins, aromatic epoxy resins, cycloaliphatic epoxy resins, ether type epoxy resins (adducts of epichlorhydrin with polyols, polyether polyols and the like), such as polyol di- and tri-glycidyl ethers, and so on; and modified products of these epoxy resins (such as modified products of epichlorhydrin with bisphenol A). Among these, preferred are adducts of epichlorhydrin with bisphenol A. Epoxy resins usually have an epoxy equivalent of generally 140–4000, preferably 190–500.

Polyurethanes of (B) are inclusive of reaction products of a diisocyanate component with a diol component. Suitable diisocyanates include, for example, aromatic diisocyanates containing 6–20 carbon atoms (except carbon atoms in NCO groups), such as 2,4- and/or 2,6-tolylene diisocyanates and 4,4'- and/or 2,4'-diphenylmethane diisocyanates; cycloaliphatic diisocyanates containing 4–15 carbon atoms, such as isophorone diisocyanate and dicyclohexymethane diisocyanate; aliphatic diisocyanates containing 2–18 carbon atoms, such as hexamethylene diisocyanate and lysine diisocyanate; araliphatic diisocyanates containing 8–15 carbon atoms, such as xylylene diisocyanate; and modified diisocyanates of these diisocyanates (such as modified ones containing urethane, carbodiimide, allophanate, urea, biuret, urethdione, urethonimine, isocyanurate and/or oxazolidone groups); as well as mixtures of two or more of them. Among these, preferred are aromatic diisocyanates. Examples of suitable diols are the same ones as mentioned above for polyesters (aliphatic diols, aromatic diols, alkylene oxide adducts thereof and polyalkyleneglycols, excepting esters and alcoholates); and polyester diols obtainable by polycondensation of a dicarboxylic acid component with a diol component as above, or by ring-opening polymerization of a lactone. Among these diols, preferred are alkylene oxide adducts of aromatic diols, aliphatic diols and combinations of them, particularly alkylene oxide adducts of aromatic diols. Polyurethanes may be OH-terminated or NCO-terminated.

In general, olymers (B) have a number-average molecular weight of about 200–about 100,000. Epoxy resins usually have a number-average molecular weight of about 200–about 10,000.

In charge controlling polymers according to the present invention, said polymers (A) and (B) are linked block-wise or/and graft-wise. Styles of linking of the moiety of (A) and the moiety of (B) include, for example, block linking forms, such as A-B, A-B-A, B-A-B, and multi-blocking; and graft forms, such as substrate A grafted with B, and substrate B grafted with A; as well as combinations of two or more of these forms. Among these, preferred are block forms of A-B and A-B-A, graft forms of substrate A grafted with B and substrate B grafted with A, and combinations of two or more of these forms, especially graft forms of substrate B grafted with A.

In this invention, it is not necessary to link all the polymers (A) and (B); and, as far as at least a part of (A) and (B) are linked block-wise or/and graft-wise, the rest of (A) and/or (B) may be remained unlinked.

Methods of producing graft polymers of (A) and (B), include, for example, macromer methods by copolymerizing a superstrate prepolymer having a polymerizable terminal group during polymerization of a substrate polymer; polymer reaction methods by reacting a superstrate prepolymer having a reactive terminal group with reactive groups in the side chains of a substrate polymer; and back bone-initiated polymerization methods by polymerizing a superstrate monomer using a substrate prepolymer as initiating sites.

Methods of producing block polymers of (A) and (B), include, for example: 1) polymer reaction methods by reacting a polymer (A) having a reactive terminal group with a polymer (B) [In these methods, polymers of A-B block can be obtained in case where both (A) and (B) have a reactive group only on one end, those of A-B-A or B-A-B block can be obtained in case where one of (A) and (B) has a reactive group only on one end and the other has reactive groups on both ends, and those of multi-block can be obtained in case where both (A) and (B) have reactive groups on both ends]; and 2) polymer-initiated polymerization methods by polymerizing one of (A) and (B) using an end or ends of a prepolymer of the other as initiating sites. [In these methods, polymers of A-B block can be obtained in case of using only one end of the prepolymer as initiating sites, and those of A-B-A or B-A-B block can be obtained in case of using both ends of the prepolymer as initiating sites].

In producing poylmers linked graft-wise and/or block-with by polymer reaction methods, reaction may be carried out between polymers after completion of polymerization, or polymer reaction may be occurred concurrently in parallel with polymerization. That is, polymerization may be terminated uopo reaction with the other polymer. These methods are not particularly restricted, and the most suitable method may be selected in accordance with desired polymers.

Suitable polymers comprising (A) and (B) linked graft-wise and/or block-with include:

I. those by macromer methods, for example, 1) copolymers of a monomer for (B) with a polymer (A) having groups (such as vinyl group, dicarboxylic group and diol group) copolymerizable with the monomer; and 2) copolymers of a monomer for (A) with a polymer (B) having groups (such as amino group, cyclic amino group, 1,3-oxaza group, dihalide and aldehyde group) copolymerizable with the monomer;

II. those by polymer reaction methods, for instance, 3) polymers obtainable by reacting a polymer (B) having carboxylic groups in the end and/or side chains with a polymer (A) having reactive groups (such as hydroxyl group, amino group and aziridinium salt group) in the end and/or side chains; 4) polymers obtainable by reacting a polymer (B) having halogen substituents in the end and/or side chains with a polymer (A) having amino groups in the end and/or side chains; 5) polymers obtainable by reacting a polymer (B) having amino groups in the end and/or side chains with a polymer (A) having reactive groups (such a halogen, carboxylic group and aldehyde group) in the end and/or side chains; and 6) polymers obtainable by reacting a coupling agent (such as diisocyanate, phosgene and dichlorodimethylsilane) with polymers (A) and (B) having in the end and/or side chains functional groups (such as hydroxyl group and amino group) reactive the coupling agent;

III. those by polymer-initiated polymerization methods, for example, 7) polymers obtainable by polymerizing a cationic polymerizable monomer (such as cyclic amine, 1,3-oxaza compound, vinylether and cyclic ethers) for (A) with a polymer (B) as initiating sites having functional groups (such as halogen and sulfonate ester group) capable of initiating cationic polymerization; 8) polymers obtainable by polymerizing a free radical polymerizable monomer (such as vinyl monomer) for polymer (A) with a polymer (B) as initiating sites having radical-deriving groups (such as groups containing tertiary carbon atom having hydrogen atom likely being drawn out with peroxide, and groups containing tertiary carbon atom easily oxidized into peroxide with ozone or oxygen, In case of polymers comprising substrate A grafted with B, substrate polymers (A) usually have a number-average molecular weight (hereinafter referred to as Mn) of about 200–about 50000, preferably about 500--about 30000, more preferably 1000–20000; and Mn of superstrate polymers (B) is generally about 500–about 100000, preferably about 1000–about 30000, more preferably 1000–20000. Extent of branching is usually 1–50 mole %, preferably 3–40%, more preferably 5–30%. Dispersibility into toner binder resins become insufficient, in case where Mn of substrates (A) is too large as compared with Mn of superstrates (B), or branching degree is too low; and enough electrostatic charging amount is not obtained, when Mn of superstrates (B) is too large as compared with Mn of substrates (A), or branching degree is too high.

In polymers comprising substrate B grafted with A, substrate polymers (B) usually have Mn of about 500--about 100000, preferably about 1000–about 50000, more preferably 2000–30000; and Mn of superstrate polymers (A) is generally about 200–about 50000, preferably about 300–about 10000, more preferably 500–5000. Extent of branching is usually 1–50 mole %, preferably 2–40%, more preferably 3–30%. Dispersibility into toner binder resins become insufficient, in case where Mn of superstrates (A) is too large as compared with Mn of substrates (B), or branching degree is too high; and enough electrostatic charging amount is not obtainable, when Mn of substrates (B) is too large as compared with Mn of superstrates (A), or branching degree is too low.

In case of block polymers, blocks (A) usually have Mn of about 200–about 50000, preferably about 300--about 20000, more preferably 500–10000; and Mn of blocks (B) is generally about 1000–about 100000, preferably about 1000–about 50000, more preferably 2000–30000. Dispersibility into toner binder resins become insufficient, in case where Mn of blocks (B) is too small as compared with Mn of blocks (A); and enough electrostatic charging amount is not obtainable, when Mn of blocks (B) is too large as compared with Mn of blocks (A).

In polymers comprising (A) and (B) linked graft-wise and/or block-with, the weight ratio of moieties (A) to (B) is usually 3:97–80:20, preferably 10:90–70:30, more preferably 20:80–50/50. Too small weight ratio of (B) to (A) results in poor dispersibility, and too large weight ratio of (B) to (A) causes reduction of electrostatic charging amount.

Illustrative examples of charge controlling polymers according to this invention are:

a) quaternarizates of graft polymers obtained by copolymerizing styrene and macromers produced by polyaddition of a diamine with a acrylamide group-terminated bisacrylamide (such as Michael addition products of piperazin with bisacryloylpiperazin);

b) graft polymers obtained by copolymerizing styrene and poly(N-substituted-aziridine)macromers [such as poly(N-t-butylaziridine)macromer] endcapped polymerization with (meth)acrylic acidslamide group-terminated bisacrylamide (such as Michael addition products of piperazin with bisacryloylpiperazin);

c) betainated products of graft polymers obtained by copolymerizing styrene and amino-containing vinyl monomer polymerizate macromers (such as dimethylaminoethyl methacrylate macromer) polymerized using vinylbenzyl magnesium chloride as initiator;

d) graft polymers obtained by reacting dihalides (such as 1,4-dibromobutane) with amines [such as (benzo)imidazole] and polystyrene radical-polymerized using 2-mercaptoethyl(benzo)imidazole as chain transfer agent;

e) block polymers obtained by reacting dihalides (such as dichloroethane) with amines (such as tetramethylethylenediamine) and diamine-modified styrenic polymers [such as azobiscyanovaleric acid-initiated styrenic polymers containing terminal carboxylic acid group, which is amidated with a diamine (such as dimethylaminopropylamine)];

f) quaternarizates of graft polymers obtained by amidating carboxyl-containing styrenic polymers [copolymers of styrene with carboxyl-containing monomer, such as (meth)acrylic acids] with reaction products of secondary diamine (such as piperazin) with dihalide (such as dichloroethylether);

g) quaternarizates of block polymers obtained by amidating carboxyl-terminated polyesters (such as polycondensates of terephthalic acid with PO adduct of bisphenol A) with reaction products of secondary diamine (such as N,N'-dimethylethylenediamine) with dihalide (such as xylylene dichloride);

h) graft polymers obtained by reacting halogen-containing styrenic polymers (copolymers of styrene with halogen-containing monomer, such as chloromethylstyrene) with reaction products of amines (such as imidazole) with dihalide (such as 1,4-dichlorobutane);

i) graft polymers obtained by reacting halogen-containing styrenic polymers (copolymers of styrene with halogen-containing monomer, such as chloromethylstyrene) with reaction products of amines (such as imidazole) with epichlorhydrin;

j) alkylated products and sulfo-betainated products of block polymers obtained by reacting styrenic polymers (such as copolymers of styrene with butyl acrylate) with hydrolyzates of isomerized ring-opening polymerization products of 1,3-oxazacompounds (such as 2-methyloxazoline);

k) graft polymers obtained by reacting amino-containing styrenic polymers (copolymers of styrene with amino-containing monomer, such as dimethylaminoethyl(meth)acrylamide) with amines (such as tetramethylethylenediamine) with dihalide (such as 1,4-dibromobutane);

l) quaternarizates of block polymers obtained by reacting amino-modified polyurethanes (such as reaction product of diphenylmethane diisocyanate and EO adduct of bisphenol A, terminated with dimethylaminoethanol) or epoxy resins (such as reaction product of epichlorhydrin with bisphenol A) with reaction products of amines (such as dimethyl amine) with dihalides (such as 1,3-dibromopropane);

m) quaternarizates of hydrolyzates of graft polymers obtained by polymerizing 1,3-oxaza compounds (such as 2-ethyloxazoline) with halogen-containing styrenic polymers (copolymers of styrene with halogen-containing monomer, such as chloromethylstyrene) as initiator;

n) graft polymers obtained by polymerizing cyclic amines (such as N-benzylethyleneimine) with halogen-containing styrenic polymers (copolymers of styrene with halogen-containing monomer, such as chloromethylstyrene) as initiator;

o) reaction products of amines (such as pyridine) with graft polymers obtained by polymerizing halogen-containing monomers (such as chloromethylstyrene) with oxydized styrenic polymers (such as oxydate of copolymer of styrene with p-cumylstyrene) as initiator; and p) quaternarizates of graft polymers obtained by polymerizing amino-containing monomers (such as vinyl pyridine) in the presence of polyolefins (such as low molecular weight polypropylene) with peroxides (such as di-t-butyl peroxide).

Charge controlling polymers according to the present invention can be internally added to toner binders beforehand to obtain toner binders having charge controlling effects.

Suitable toner binders include for example, styrenic polymers, polyesters, epoxy polymers, olefinic polymers and polyurethanes. Examples of these polymers include the same ones as mentioned above polymers (B). Illutrative of preferable polymers are copolymers of styrene with (meth)acrylate ester or combination thereof with other comonomer, and copolymers of styrene with dienes (such as butadiene and isoprene) or combination thereof with other comonomer; polycondensates of aromatic dicarboxylic acids with alkylene oxide adducts of aromatic diols; reaction products of epichlorhydrin with aromatic diol, and modified products of these; polyethylene, polypropyrene, and copolymers of these with other copolymerizable monomer; as well as reaction products of aromatic diisocyanates with alkylene oxide adducts of aromatic diols. Among these, preferred are styrene/acrylic copolymers and polyester resins.

Molecular weight of toner binders may vary widely; but preferred are those having a weight-average molecular weight (Mw), which can be measured by GPC (gel permeation chromatography) using tetrahydrofulan (hereinafter referred to as THF) with use of calibration curve of standard polystyrenes, of usually about 100,000–about 2,000,000, preferably about 150,000–about 1,500,000. Molecular weight distribution [represented by Mw/Mn] of toner binders is generally at least about 20, preferably at least about 30. Glas transition temperature (hereinafter referred to as Tg) of toner binder resins is generally about 40–about 80 degrees C., preferably about 45–about 70 degrees C.

In combinations of toner binders with charge controlling polymers according to this invention, it is preferred that the toner binder and the moiety of polymer (B) of the charge controller are of near structure as far as possible. For instance, in case of using a styrenic polymer as toner binder, it is preferable to use a styrenic polymer as the moiety (B) in the charge controller. When the structure of the toner binder is not much near to that of (B), dispersibility of the charge controller into the toner binder is liable to become insufficient.

Weight ratio of toner binder to charge controlling polymer in the invention is generally 99:1–50:50, preferably 98:2–70:30, more preferably 97:3–80:20.

Suitable methods of internally adding charge controller into toner binder include, for example, those by polymerizing precursors (monomers) of toner binders in the presence of charge controller; those by solution mixing of toner binder resin after polymerization with use of solvent [aromatic hydrocarbons, such as toluene and xylene; halogenated hydricarbons, such as chloroform and ethylene dichloride; ketones, such as acetone and methyethylketone; amides, such as dimethylformamide (hereinafter referred to as DMF); and so on]; and those by mixing under hot-melt toner binder with charge controller.

Electrophotographic toner, according to this invention, comprises generally about 1–about 40% of said charge controller of the invention, about 30–about 95% by weight of toner binder and about 3–about 20% (preferably 5–10%) of colorant (inorganic and organic pigments, such as carbon black, iron black, benzidine yellow, quinacridone pigments, rhodamine B, phthalocyanine pigments and the like); and may contain magnetic powder (such as powders of ferromagnetic metals and compounds, such as iron, cobalt, nickel, magnetite, hematite, ferrite and the like) in an amount of generally 0–about 50%; and other additives [for example, lubricants (such as polytetrafluoroethylene, low molecular weight polyolefins, fatty acids and metal salts or amides thereof), other charge controllers (such as metal complexes and nigrosine), and so on] if desired, in an amount of 0–about 5% (preferably 0–5%).

Electrophotographic toner can be prepared by dry blending these components and then melted under kneading, followed by crushing, and then finely pulverizing with a grinder (such as jet grinder), thereafter classifying to obtain particles of 5–20 microns diameter.

Said toner can be optionally mixed with one or more carrier particles, such as iron powder, glass beads, nickel powder and ferrite, and used as a developer for electrical latent images. Besides, hydrophobic colloidal silica powder may be used to improve flowability of powders.

Said toner can be fixed on substrates, such as paper, polyester film and the like. Fixation may be accomplished by any known Fixation means, such as heat roll fixation.

Having generally described the invention, a more complete understanding can be obtained by reference to certain specific examples, which are included for purposes of illustration only and not intended to be limiting unless otherwise specified.

In the following examples, parts and ratio mean parts by weight and weight ratio, respectively.

Conditions of measuring molecular weight with GPC are as follows:

Equipment: produced by Waters.
Columns: Ultrastyragellinear, 2 columns,
Temperature: 25 degrees C.
Sample solution: 0.5% THF solution.
Amount of solution: 200 microlitters.
Detector: Refractometer Mw calibration curve was prepared using standard polystyrenes.

EXAMPLE 1 AND COMPARATIVE EXAMPLES 1–2

1) Example 1

(a) In toluene under reflux, 776 parts of styrene, 147 parts of butyl acrylate and 77 parts of chloromethylstyrene were polymerized initiated with 35 parts of azobisisobutyronitrile, follwed by removing the solvent to obtain a styrenic polymer (1) having Mn of 4800 and Mw of 13000.

(b) Then, 675 parts of the styrenic polymer (1), 148 parts of benzoimidazole, 202 parts of 1,4-dibromobutane, 40 parts of benzylchloride and 70 parts of potassium hydroxide were reacted in DMF for 4 hours at 50 degrees C. and 4 hours under reflux. Subsequently, 275 parts of sodium borofluoride was added thereto and reflux was continued for an hour. After completion of reaction, the reaction product was precipitated into water, filtered and then dried to obtain a polymer (hereinafter referred to as Controller 1).

2) Comparative Example 1

In the same manner as Example 1(b), 912 parts of the styrenic polymer (1), 97 parts of 1-benzylbenzoimidazole, and 93 parts of sodium borofluoride were reacted to obtain a polymer (hereinafter referred to as Controller 1*).

3) Comparative Example 2

In the same manner as Example 1(a), 545 parts of styrene, 147 parts of butyl acrylate and 308 parts of chloromethylstyrene were polymerized to obtain a styrenic polymer (2).

In the same manner as Example 1(b), 912 parts of the styrenic polymer (2), 388 parts of 1-benzylbenzoimidazole, and 372 parts of sodium borofluoride were reacted to obtain a polymer (hereinafter referred to as Controller 2*).

Preparation of Toners

From Controllers 1, 1* and 2*, were prepared Toners 1, 1* and 2*, respectively, as follows:

Each charge controller (100 parts) was powder blended with 780 parts of a styrene-acrylic toner binder (styrene-butyl acrylate copolymer having Mn of 4800 and Mw of 253000), 80 parts of carbon black (MA100 produced by Mitsubisi Chemical Industries) and 40 parts of a low molecular weight polypropylene (Viscol 660P, produced by Sanyo Chemical Industries), followed by kneading with a laboplastomill for 10 minutes at 140 degrees C. ×30 r.p.m. and then finely pulverizing the cooled kneaded mixture with a jet mill (PJM100 produced by Nippon Newmatic). From the resulting fine powders, toners of 5–20 microns diameter was obtained using an airborne classifyer (MDS produced by Nippon Newmatic).

Measurement of Electrostatic Charge 25 parts of each toner were mixed homogeneously with 1000 parts of iron powder carrier (ASR-10 produced by Nippon Teppun Co.); and the mixture was electrostatically charged by friction with a tumbler shaker mixer and the amount of electrostatic charge was measured using a blow-off electrostatic charge meter (produced by Toshiba Chemical). The results were as shown in Table 1.

TABLE 1

| Charge Controller | Toner No. | Electrostatic charge (microC/g) 1 min. | 3 min. | 15 min. | 40 min. |
|---|---|---|---|---|---|
| Controller 1 | Toner 1 | +12.9 | +13.3 | +13.2 | +13.4 |
| Controller 1* | Toner 1* | +11.5 | +13.1 | +14.8 | +16.2 |
| Controller 2* | Toner 2* | +6.2 | +7.0 | +7.4 | +7.8 |

Copying Test

Copying test of each toner was carried out with an electrophotographic copying machine for positively charged toner using OPC sensitized material. Toner 1 of this invention provided a blush-free, clear black printed image with excellent reproductivity of thin line, and showed no reduction of copy qualities even after continuous copying of 10,000 sheets. On the other hand, Toner 1* for comparison showed reduction of copy qualities upon continuous copying, and copying over 10,000 sheets was impossibile.

EXAMPLE 2 AND COMPARATIVE EXAMPLE 3

1) Example 2

(a) In the same manner as Example 1(a), 691 parts of styrene, 155 parts of butyl acrylate and 154 parts of chloromethylstyrene were polymerized to obtain a styrenic polymer (3).

(b) Into a DMF solution of 409 parts of imidazole and 82.1 parts of 1-methylimidazole, 555 parts of epichlorhydrin were added over 2 hours at 50 degrees C. and reacted for 10 hours at 100 degrees C. Then, 947 parts of the styrenic polymer (3) was added thereto and reacted for 4 hours under reflux, followed by adding 1977 parts of sodium salt of Nevile-Winther's acid and then treating in the same manner as Example 1(b) to obtain a polymer (hereinafter referred to as Controller 2).

2) Comparative Example 3

Example 2(b) was repeated, except that the styrenic polymer (3) was not added, to obtain a polymer (hereinafter referred to as Controller 3*).

Preparation of Toners

Toners 2 and 3* were prepared in the same manner as Example 1, except that 100 parts of Controller 1 and 50 parts of Controller 3*, respectively, were used in stead of Controller 1.

Measurement of Electrostatic Charge Distribution

Upon measuring distribution of electrostatic charge amount with a particle electrostatic charge distribution measuring device (EST-1 produced by Hosokawamicron), Toner 2 of the invention showed a sharp distribution of electrostatic charge amount, while Toner 3* for comparison resulted in a broad distribution of electrostatic charge amount containing reverse charged particles.

Copying Test

Copying test of each toner was carried out similarly to Example 1. Toner 2 of this invention provided a blush-free, clear black printed image with excellent reproductivity of thin line, and showed no reduction of copy qualities even after continuous copying of 10,000 sheets. On the other hand, Toner 3* for comparison caused blushing at early stages of continuous copying.

EXAMPLE 3 AND COMPARATIVE EXAMPLE 4

1) Example 3

In the same manner as Example 1(a), 310 parts of the styrenic polymer (3), 314 parts of beta,beta'-dichloroethylether, 40 parts of benzyl chloride, 140 parts of potassium hydroxide and 741 parts of sodium salt of Nevile-Winther's acid were reacted to obtain a polymer (hereinafter referred to as Controller 3).

Preparation of Toners

Toners 3, 4, 5 and 4* were prepared in the same manner as Example 1, except that 30 parts, 50 parts, 100 parts and 0 parts, respectively, of Controller 3 were used in stead of Controller 1.

Measurement of Electrostatic Charge

Electrostatic charge amount was measured in the same manner as Example 1, except using 500 parts of a ferrite carrier (TEFV200/300 produced by Nippon Teppun Co.) in stead of iron powder carrier (ASR-10). The results were as shown in Table 2.

TABLE 2

| Charge Controller | Toner No. | Electrostatic charge (microC/g) 1 min. | 3 min. | 15 min. | 40 min. |
|---|---|---|---|---|---|
| Controller 3 | Toner 3 | +6.8 | +7.0 | +7.1 | +7.1 |
| Controller 3 | Toner 4 | +10.2 | +10.5 | +10.4 | +10.6 |
| Controller 3 | Toner 5 | +14.7 | +14.9 | +15.2 | +15.2 |
| none | Toner 4* | −6.8 | −10.5 | −15.4 | −22.2 |

EXAMPLE 4 AND COMPARATIVE EXAMPLE 5

1) Example 4

(a) In diethylether under reflux, 15.2 parts of chloromethylstyrene and 2.5 parts of metallic magnesium were reacted to obtain a diethylether solution of vinylbenzylmagnesium chloride. To 1000 parts of tetrahydrofuran (hereinafter referred to as THF), were added 117 parts of this solution under an atmosphere of dry nitrogen, and cooled to −78 degrees C. Then, 157 part of dimethylaminoethyl ethacrylate were added thereto and polymerized for 24 hours at −78 degrees C. After stopping polymerization with a small amount of methanol, the polymerizate was precipitated into hexane, filtered and then dried to obtain a polydimethylaminoethylmethacrylate acromer (Mn 2500).

(b) Then, 33 parts of styrene and 42 parts of the above acromer were polymerized in DMF at 1200 degrees C. initiated with 4 parts of azobisisobutyronitrile. After termination of polymerization and then cooling, 37 parts of benzylchloride was added dropwise thereto at 50 degrees C. and reacted for 4 hours at 100 degrees C. Thereafter, 1000 parts of the same styrene-acrylic toner binder as in Example 1 were added thereto and dissolved under reflux, followed by removing the solvent to obtain a polymer (hereinafter referred to as Binder 4) containing charge controller of this invention.

Preparation of Toners

Toner 6 was prepared in the same manner as Example 1, except using Binder 4 without using Controller 1. Toner 5* was prepared using the same styrene-acrylic toner binder as in Example 1 in the same manner as Example 1, except using 30 parts of a nigrosine dye in stead of Controller 1. Toner 6 was pale yellow, while Toner 5* was purplish black.

Measurement of Electrostatic Charge Distribution 50 parts of each toner were electrostatically charged by friction with 950 parts of ferrite carrier (F-100 produced by Nippon Teppun Co.); and distribution of electrostatic charge amount was measured in the same manner as Example 2. Toner 6 of the invention showed a sharp distribution of electrostatic charge amount; while Toner 5* for comparison resulted in a broad distribution of electrostatic charge amount, and much reverse charged particles were observed particularly in smaller diameter portion (5 microns or less).

EXAMPLE 5

Using dibutyltin dilaurate as catalyst, 199 parts of terephthalic acid and 350 parts of 3 mole PO adduct of bisphenol A were reacted at 220 degrees C. to obtain a polyester (1) having acid value of 50 mgKOH/g and hydroxyl value of 9 mgKOH/g.

To a solution of 99 parts of t-butylaziridine dissolved in THF/HMPT (9/1), were added 8.3 parts of methyltriphrate at 15 degrees C. After 5 minutes, 100 parts of the polyester (1) were added thereto and then reacted for an hour. The reaction product was precipitated into methanol, filtered and then dried to obtain a polymer (hereinafter referred to as Controller 5).

Preparation of Toners

In the same manner as Example 1, 840 parts of a polyester toner binder (polycondensate of terephthalic acid and trimellitic anhydride with 2 mole EO adduct of bisphenol A and 2 mole PO adduct of bisphenol A; Mn 5,500; Mw 105,000), 150 parts of Controller 5 and 10 parts of Kayaset Red 130 were powder blended, kneaded, then finely pulverized and classified to obtain a toner of the invention (Toner 7).

The above procedure was repeated without using Controller 5 to obtain a toner for comparison (Toner 6').

Measurement of Electrostatic Charge

In the same manner as Example 1, electrostatic charge amount after 20 minutes was measured. The electrostatic charge amount of Toner 7 was +16 microC/g, whereas that of Toner 6* was negatively charged −17 microC/g.

Copying Test

Copying test of each toner was carried out with the same copying machine in Example 1 onto a transparent polyester sheet for OHP. Toner 7 of this invention provided a printed image of clear color tone free frm any turbidity, while adequate image wasn't obtained using Toner 6*.

EXAMPLE 6

Using dibutyltin oxide as catalyst, 294 parts of terephthalic acid and 770 parts of 2 mole EO adduct of bisphenol A were reacted at 230 degrees C. to obtain a polyester (2) having acid value of 0.5 mgKOH/g and hydroxyl value of 66 mgKOH/g.

In the presence of 19 parts of 2-mercaptoethanol, 376 parts of dimethylaminoethyl methacrylate and 249 parts of styrene were polymerized in DMF at 120 degrees C. initiated with 5 parts of azobisisobutyronitrile. Then, 500 parts of the polyester (2) and 200 parts of diphenylmethane diisocyanate were added thereto and reacted for 6 hours at 80 degrees C., followed by adding 317 parts of benzyl chloride to the resulting polyurethane to quaternarize it. Thereafter the solvent was removed to obtain a polymer (hereinafter referred to as Controller 6).

Preparation of Toners

In the same manner as Example 1, 940 parts of the same polyester toner binder as Example 5, 50 parts of Controller 6 and 10 parts of Kayaset Blue N were powder blended, kneaded, then finely pulverized and classified to obtain a toner of the invention (Toner 8).

The above procedure was repeated except using 8 parts of trimethylbenzylammonium Nevile-Winthate (a colorless positively charging charge controller) in stead of Controller 6 to obtain a toner for comparison (Toner 7').

Measurement of Electrostatic Charge and Distribution

In the same manner as Example 1, electrostatic charge amount was measured. The results were as shown in Table 3.

TABLE 3

| Charge Controller | Toner No. | Electrostatic charge (microC/g) 1 min. | 3 min. | 15 min. | 40 min. |
|---|---|---|---|---|---|
| Controller 6 | Toner 8 | +11.2 | +11.5 | +11.5 | +11.5 |
| Known one | Toner 7* | +8.2 | +10.1 | +10.5 | +10.6 |

Distribution of electrostatic charge amount was measured in the same manner as Example 2. Toner 8 of the invention showed substantially no reverse charged particles; while reverse charged particles were observed in case of Toner 7* for comparison.

Copying Test

Copying test of each toner was carried out with the same copying machine in Example 1. Toner 8 of this invention provided a blush-free printed image of clear blue tone, and showed no reduction of copy qualities even after continuous copying of 10,000 sheets. On the other hand, Toner 7* for comparison caused blushing at early stages, and resulted in reduction of copy qualities upon continuous copying.

Charge controllers according to the present invention, having effects as follows, are useful for toners in electrophotography, electrostatic recordinf paper and the like.

1) Said charge controllers have improved dispersibility into toner binders, and therefore can provide toners of sharp distribution of electrostatic charge amount.

2) Said charge controllers, having excellent adhesion properties, can provide toners of improved spentability.

3) Said charge controllers, which forms micro-structure of phase-separation within toner, are capable of keeping stably electrostatic charge without forming electrical continuity of toner, different from a kind of charge controller perfectly compatible to toner binder.

4) It is easy to to make sutrucrute of high thermal resistance [such as (benzo)imidazolium salt structure] if necessary, whereby change of properties during toner-forming process can be reduced.

5) By adjusting the amount added to toner, saturated electrostatic charge amount can be controlled independently without changing stability of electrostatic charge; while a sort of low molecular weight charge controller causes changing of stability of electrostatic charge along with saturated electrostatic charge upon varying the amount into toner.

6) Said charge controllers, which are substantialy colorless, may be used for color toner.

Toners containing charge controller of the invention are capable of maintaining stably clear printed images (images of proper concentration, free from smears in ground color with blushing.

What is claimed as new and desired to be secured by Letters Patent is:

1. An electrophotographic toner, which comprises a toner binder and a charge controlling polymer, said polymer comprising moiety of (A) a polymer having amino group-containing monomer units and moiety of (B) at least one polymer selected from the group consisting of styrenic polymers, olefinic polymers, polyesters, epoxy resins and polyurethanes; the moiety of (A) and the moiety of (B) being linked block-wise or graft-wise, or in combination; wherein the amino group is selected from the group consisting of primary, secondary and tertiary amino groups, salts thereof and quaternary ammonium salts; wherein the weight ratio of the toner binder to said polymer is 99:1–50:50.

2. The toner of claim 1, wherein said polymer (A) contains amino-containing groups selected from the group consisting of those represented by any of the formulae (1), (2), (3), (4), (5) and (6):

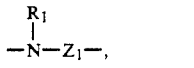
(1)

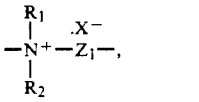
(2)

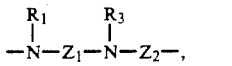
(3)

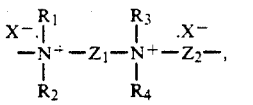
(4)

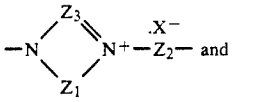
(5)

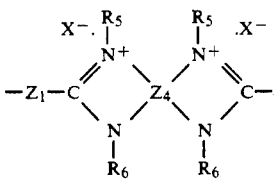
(6)

wherein $R_1$, $R_2$, $R_3$, $R_4$, $R_5$ and $R_6$ are independently selected from the group consisting of hydrogen atom and monovalent substituted or unsubstituted hydrocarbon groups, containing up to 18 carbon atoms; or $R_1$ and $R_2$, $R_1$ and $R_3$, $R_2$ and $R_4$, $R_3$ and $R_4$ or two or more of these combinations may be joined each other to form a heterocyclic ring; or $R_1$ and $R_2$ or $R_3$ and $R_4$ may be joined with a part of $Z_1$ to form a heterocyclic ring; $Z_1$, $Z_2$ and $Z_3$ are independently selected from the group consisting of divalent substituted and unsubstituted hydrocarbon groups, containing up to 18 carbon atoms, which may contain at least one linkage selected from the group consisting of ether, thioether, ester, amide and imide linkages; $Z_4$ is a tetravalent aromatic group, which may contain at least one linkage selected from the group consisting of ether and thioether linkages; and $X^-$ is an anionic counter ion.

3. The toner of claim 2, wherein said monovalent substituted or unsubstituted hydrocarbon groups are selected from the group consisting of alkyl, aralkyl, aryl, cycloalkyl and hydroxyalkyl groups.

4. The toner of claim 2, wherein said heterocyclic ring, formed from $R_1$ and $R_2$, $R_1$ and $R_3$, $R_2$ and $R_4$, $R_3$ and $R_4$, or $R_1$ and $R_2$ or $R_3$ and $R_4$ with a part of $Z_1$, is selected from the group consisting of morpholine ring, piperidine ring, pipecoline ring, lupetidine ring, piperazine ring, pyridine ring, quinoline ring and acridine ring.

5. The toner of claim 2, wherein said polymer (A) has a polymer backbone comprising repeating monomer units represented by any of the formulae (1), (2), (3), (4), (5) and (6).

6. The toner of claim 2, wherein said polymer (A) comprising repeating monomer units containing amino-containing groups selected from the group consisting of those represented by any of the formulae (1), (2), (3), (4), (5) and (6) in the side chain.

7. The toner of claim 2, wherein said polymer (A) comprising repeating monomer units containing amino-containing groups represented by the formula (5), wherein $Z_1$ is alkenylene or arylene group and $Z_3$ is a divalent substituted and unsubstituted hydrocarbon group of the formula =CR— (wherein R is H, methyl, ethyl, benzyl, phenyl, 2-hydroxyethyl or 2-methoxyethyl).

8. The toner of claim 1, wherein said repeating monomer units are selected from the group consisting of amino-containing vinyl monomer units, amino-containing polyether monomer units, amino-containing polyester monomer units.

9. The toner of claim 1, wherein said polymer (A) comprises 30–100 mole % of amino group-containing monomer units and 0–70 mole % of other copolymerizable monomer units.

10. The toner of claim 1, wherein said polymer is at least one polymer selected from the group consisting of graft polymers comprising a substrate of said polymer (A) having a number-average molecular weight of about 200–about 50,000, and 1–50 mole % of superstrates of said polymer (B) having a number-average molecular weight of about 500–about 100,000; and graft polymers comprising a substrate of said polymer (B) having a number-average molecular weight of about 500–about 100,000, and 1–50 mole % of superstrates of said polymer (B) having a number-average molecular weight of about 200–about 50,000, wherein the weight ratio of (A) to (B) is 3:97–80:20.

11. The toner of claim 1, wherein said polymer is at least one block polymer comprising blocks of said polymer (A) having a number-average molecular weight of about 200–about 50,000 and blocks of said polymer (B) having a number-average molecular weight of about 500–about 100,000, wherein the weight ratio of (A) to (B) is 3:97–80:20.

12. The toner of claim 1, wherein said polymer (B) is at least one styrenic polymer selected from the group consisting of polystyrene and copolymers of styrene with one or more comonomer selected from the group consisting of other aromatic vinyl monomers, acrylic or methacrylic monomers, vinyl esters, aliphatic vinyl monomers, halogen-containing vinyl monomers and unsaturated carboxylic monomers, which polymer has a number-average molecular weight of about 200–about 100,000.

13. The toner of claim 1, wherein said polymer (B) is at least one olefinic polymer selected from the group consisting of (i) polyolefins selected from the group consisting of polyethylene, polypropylene and copolymers of ethylene with one or more alph-olefins containing 3–8 carbon atoms; (ii) polyolefins (i) modified with maleic acid or derivatives thereof; and (iii) oxidized polyolefins (i), which polymer has a number-average weight of weight of about 200–about 100,000.

14. The toner of claim 1, wherein said polymer (B) is at least one polyester selected from the group consisting of (i) polycondensates of at least one carboxylic component selected from the group consisting of aromatic and aliphatic dicarboxylic acids and ester-forming derivatives thereof, with at least one polyol component selected from the group consisting of aromatic and aliphatic diols, ester-forming derivatives thereof, and polyoxyalkylene diols; and (ii) polylactones, which polymer has a number-average molecular weight of about 200–about 100,000.

15. The toner of claim 1, wherein said polymer (B) is at least one epoxy resin selected from the group consisting of bisphenol epoxy resins, phenol-novolak epoxy resins, cresol-novolak epoxy resins, phenol epoxy resins, aromatic epoxy resins, cycloaliphatic epoxy resins, polyol di- and tri-glycidyl ethers, which epoxy resin has a number-average molecular weight of about 200–about 10,000.

16. The toner of claim 1, wherein said polymer (B) is at least one polyurethane obtained by reacting (i) at least one polyisocyanate selected from the group consisting of aromatic, aliphatic and cycloaliphatic diisocyanates containing up to 20 carbon atoms and modified polyisocyanate thereof, with (ii) at least one polyol selected from the group consisting of aromatic and aliphatic diols and polyoxyalkylene diols; which polyurethane has a number-average molecular weight of about 200–about 100,000.

17. The toner of claim 1, which comprises 1–40% by weight of said charge controling polymer, 50–95% by weight of a binder resin, 3–20% by weight of a colorant, 0–50% by weight of a magnetic powder, and 0–20% by weight of one or more other additives.

18. The toner of claim 1, which further contains up to 30%, based on the weight of the toner of at least one low molecular weight polyolefin having a weight-average molecular weight of about 1,000–about 100,000.

19. A process for producing the toner of claim 1, which comprises blending said charge controling polymer in the form of a solution or a melt with a binder resin to disperse thereinto, and mixing therewith a colorant.

20. A method of fixing a toner image by means of a fuser roller, the toner image consisting essentially of the toner of claim 1.

21. The toner of claim 1, wherein the toner binder and the moiety of polymer (B) of said polymer are of near structure.

* * * * *